US008540407B2

(12) United States Patent
Park et al.

(10) Patent No.: US 8,540,407 B2
(45) Date of Patent: Sep. 24, 2013

(54) HEAD LAMP FOR VEHICLE

(75) Inventors: Jong Bae Park, Seoul (KR); Byoung Suk Ahn, Suwon-si (KR); Young Sub Oh, Suwon-si (KR); Tae-Won Lee, Yongin-si (KR); In Heum Park, Seongnam-si (KR)

(73) Assignees: Hyundai Motor Company, Seoul (KR); Hyundai Mobis, Seoul (KR)

( * ) Notice: Subject to any disclaimer, the term of this patent is extended or adjusted under 35 U.S.C. 154(b) by 128 days.

(21) Appl. No.: 13/205,412

(22) Filed: Aug. 8, 2011

(65) Prior Publication Data

US 2012/0113664 A1 May 10, 2012

(30) Foreign Application Priority Data

Nov. 10, 2010 (KR) ..... 10-2010-0111693

(51) Int. Cl.
*F21V 7/00* (2006.01)

(52) U.S. Cl.
USPC ..... 362/516; 362/466; 362/509; 362/512; 362/538

(58) Field of Classification Search
USPC ..... 362/460, 464, 465, 466, 467, 509, 362/516, 517, 518, 538, 512, 514; 315/77, 315/82; 353/13
See application file for complete search history.

(56) References Cited

U.S. PATENT DOCUMENTS

| | | | | |
|---|---|---|---|---|
| 2006/0262552 | A1* | 11/2006 | Komatsu et al. | 362/539 |
| 2008/0007961 | A1* | 1/2008 | Mochizuki et al. | 362/465 |
| 2008/0055921 | A1* | 3/2008 | Suzuki | 362/539 |
| 2008/0112180 | A1* | 5/2008 | Okada | 362/518 |
| 2009/0097268 | A1* | 4/2009 | Mochizuki | 362/538 |
| 2009/0122567 | A1* | 5/2009 | Mochizuki et al. | 362/509 |
| 2010/0046244 | A1* | 2/2010 | Tatsukawa | 362/539 |

FOREIGN PATENT DOCUMENTS

| | | | |
|---|---|---|---|
| JP | 2002-093217 | A | 3/2002 |
| JP | 2004-136838 | A | 5/2004 |
| JP | 2006-298333 | A | 11/2006 |
| JP | 2008-130465 | A | 6/2008 |
| KR | 10-2005-0009119 | A | 1/2005 |
| KR | 10-2009-0064725 | A | 6/2009 |
| KR | 10-2009-0126158 | A | 12/2009 |

* cited by examiner

*Primary Examiner* — Anh Mai
*Assistant Examiner* — Kevin Quarterman
(74) *Attorney, Agent, or Firm* — Morgan, Lewis & Bockius LLP

(57) ABSTRACT

A head lamp for a vehicle is provided, which includes a reflector for reflecting light emitted from a light source, a reflection plate for collecting the light reflected from the reflector in an upward direction, a micro-reflection module provided over the reflector to tilt and reflect the light collected by the reflection plate at a desired angle, and an optical lens for irradiating the light reflected from the micro-reflector onto a road surface. The head lamp can implement various beam patterns in accordance with road and surrounding circumferences, and irradiate vehicle information onto a road surface, thereby reducing the dazzle of other drivers of opposite vehicles and improving the field of vision of the driver to improve the safety and convenience.

3 Claims, 6 Drawing Sheets

<Prior Art>

<Prior Art>

<Prior Art>

HEAD LAMP FOR VEHICLE

CROSS-REFERENCE TO RELATED APPLICATION

This application is based on and claims priority from Korean Patent Application Number 10-2010-0111693 filed Nov. 10, 2010, the entire contents of which application is incorporated herein for all purposes by this reference.

BACKGROUND OF INVENTION

1. Field of Invention

The present invention relates to a head lamp for a vehicle, and more particularly, to a head lamp which can display diverse beam patterns and irradiate vehicle information onto a road surface.

2. Description of Related Art

In general, a head lamp, which is also called a vehicle headlight, is an illumination lamp that emits light in the front direction of the vehicle in which the vehicle travels. The head lamp requires brightness to enable a driver to verify obstacles on a road at night, in which the obstacles are 100 m from the front of the vehicle.

Specifications for the head lamp are differently set depending upon countries. In particular, the irradiation direction of the beam from the head lamp is differently set in accordance with right-hand traffic or left-hand traffic.

Meanwhile, the head lamp for the vehicle includes a single reflector formed in one unit, or one reflector, a shield for dividing the light reflected from the reflector into a desired beam pattern, and a lens for irradiating the beam onto a road.

In order to achieve a desired beam pattern by the common head lamp, shields of several shapes for forming various beam patterns are mounted on a shield portion, and the wanted beam pattern is obtained by rotating the shield.

In addition, in the case of the head lamp made of only one reflector, it can obtain one predetermined beam pattern.

In a case of a beam pattern variable head lamp, so-called AFLS (adaptive front lighting system) head lamp, four types of beams, such as beam for national highway, beam for city street, beam for expressway, and beam for bad weather, are obtained by rotating the above-described shield. In a case of a glare-free lamp for decreasing dazzle of a driver of an opposite vehicle or leading vehicle and maintaining a field of vision of the driver with full beam, or a case of notifying the driver and pedestrians of a danger by irradiating specific light onto an object or a person around a traveling traffic lane, a separate light source of a structure is added to implement the function.

There is no technology of irradiating the vehicle information on the road surface so far, and a head-up display for displaying vehicle information on a windshield of a vehicle has been used as a similar information transmitting system.

However, in the case where such general head lamps are the AFLS head lamp, it is limited to realizable beam patterns due to structure limitation in the shield. In addition, it is difficult to obtain the accurate beam pattern due to allowance generated when the shield is coupled to a motor for driving the shield.

In addition, since the separate light source or structure should be added, it is limited to a cost or lamp layout. Further, since the structurally set shield should be used, there is a limit to the dazzle of the driver or irradiation of the light to the pedestrian. Further, it is not possible for the common head lamps to irradiate the vehicle information on the road surface. In the case of the HUD technology, since the information is displayed on the windshield of the vehicle, the driver should see alternatively the traveling road and the windshield so as to recognize the information, which is inconvenient to park.

FIG. 1 is a view illustrating a distribution state of the beam irradiated from the head lamp for the vehicle in the related art.

The head lamp for the vehicle in the related art is set such that the beam of the left-hand driving (LHD) vehicle is irradiated further to the right in the traveling direction of the vehicle on a centerline 12, as shown in FIG. 1.

By adjusting the beam irradiation direction of the head lamp, the amount of the beam irradiated to the opposite driver is decreased to reduce the dazzle of the driver.

Meanwhile, the right-hand driving (RHD) vehicle has a beam irradiation distribution as indicated by a dotted line on the road for the same purpose as the left-hand driving vehicle.

The beam irradiation direction and the irradiation amount are adjusted by changing the shape of the shield installed in the head lamp. For example, the head lamp closer to the centerline is adjusted to reduce the beam irradiation amount.

However, if the right-hand traffic vehicle 10 having the base irradiation distribution indicated by the dotted line keeps to the left as described in the drawing, the beam irradiated from the head lamp directly puts obstacles in the field of vision of the opposite driver, which increase the risk of an accident. Further, since the amount of the beam irradiated in the forward direction is decreased, the driver of the right-hand traveling vehicle is hard to read a sign on the road.

In order to solve the above problems, as shown in FIG. 2, the head lamp is provided with a stationary shield 14 and a movable shield 16. If necessary, a light shielding region is expanded by rotating the movable shield 16.

That is, in addition to the shield mounted in the head lamp, the stationary shield 14 and the movable shield 16 are further provided, and as shown in FIG. 3, the head lamp is provided at the outside thereof with an operating lever 20 for pivoting the movable shield 16 and an operation handle 18 for moving the operating lever 20. The movable shield 16 can be pivoted, while the stationary shield 14 is always stationary.

In the system using the movable shield 18 as described above, the beam pattern for the left-hand traffic is not converted to the beam pattern for the right-hand traffic, but the upward light is shielded to prevent the dazzle of the opposite driver. In this instance, there is a problem in that the distance of the beam is short and the light width is decreased, the driver is not provided with information required for the road traveling, thereby increasing the risk of an accident. Therefore, head lamps for the left-hand driving vehicle and the right-hand driving vehicle should be respectively developed.

The information disclosed in this Background section is only for enhancement of understanding of the general background of the invention and should not be taken as an acknowledgement or any form of suggestion that this information forms the prior art already known to a person skilled in the art.

SUMMARY OF INVENTION

Accordingly, various aspects of the present invention has been made to address the above-mentioned problems occurring in the prior art while advantages achieved by the prior art are maintained intact.

Various aspects of the present invention provide for a head lamp which can display diverse beam patterns and irradiate vehicle information onto a road surface.

In one aspect of the present invention, there is provided a head lamp, which includes a reflector for reflecting light emitted from a light source, a reflection plate for collecting the light reflected from the reflector in an upward direction, a micro-reflection module provided over the reflector to tilt and reflect the light collected by the reflection plate at a desired angle, and an optical lens for irradiating the light reflected from the micro-reflector onto a road surface.

The head lamp according to the present invention as described above can implement various beam patterns in accordance with road and surrounding circumferences, and irradiate vehicle information onto a road surface, thereby reducing the dazzle of other drivers of opposite vehicles and improving the field of vision of the driver to improve the safety and the convenience.

The methods and apparatuses of the present invention have other features and advantages which will be apparent from or are set forth in more detail in the accompanying drawings, which are incorporated herein, and the following Detailed Description, which together serve to explain certain principles of the present invention.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention (s) is/are intended to cover not only the exemplary embodiments, but also various alternatives, modifications, equivalents and other embodiments, which may be included within the spirit and scope of the invention as defined by the appended claims.

Figure 1:
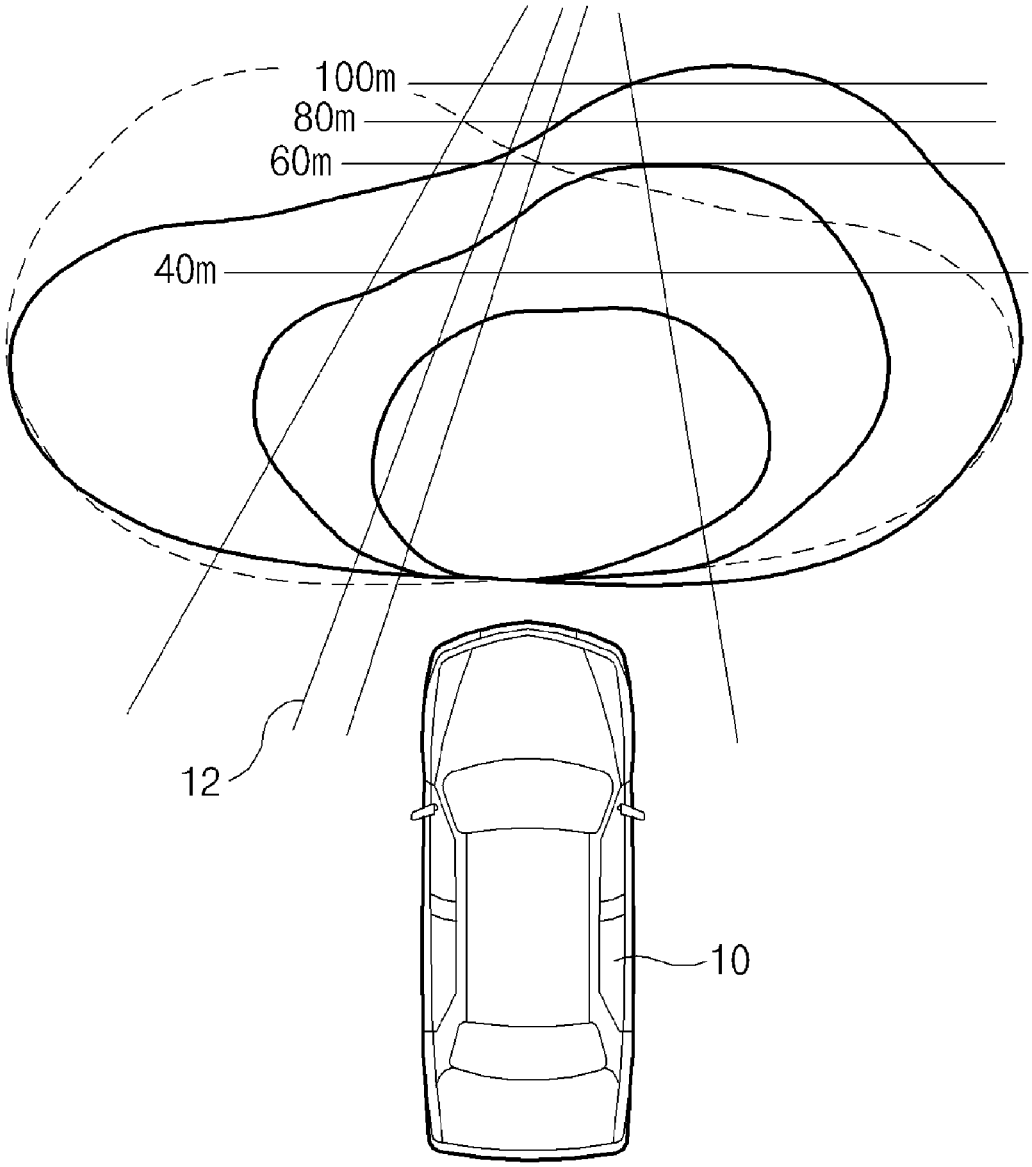
FIG. 1 is a view illustrating a distribution state of a beam irradiated from a head lamp for a vehicle in the related art.
Figure 2:
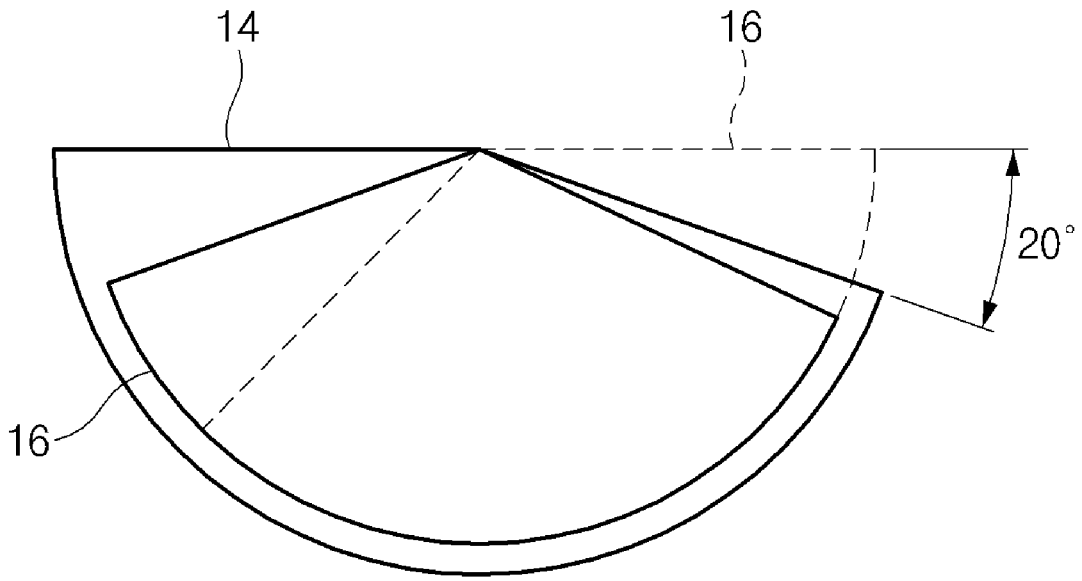
FIGS. 2 and 3 are views illustrating a head lamp for a vehicle in the related art.
Figure 3:
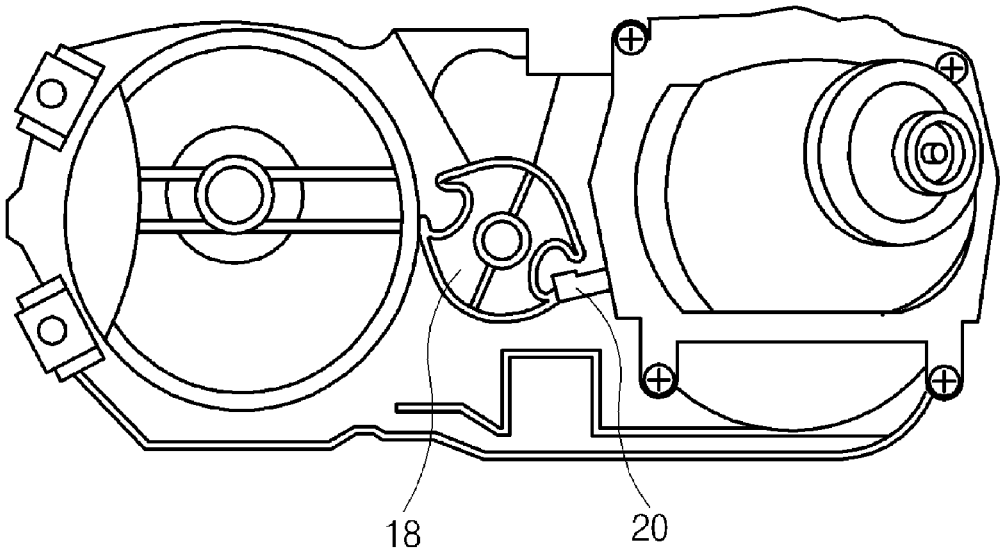
Figure 4:
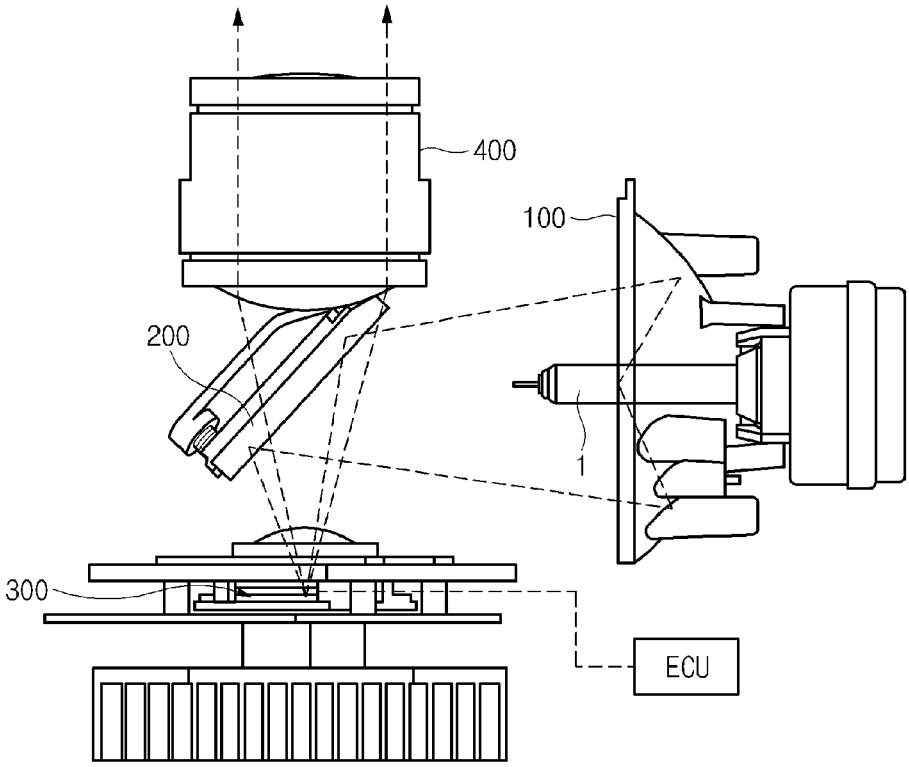
FIG. 4 is a view illustrating an exemplary head lamp for a vehicle according to the present invention.
Figure 5:
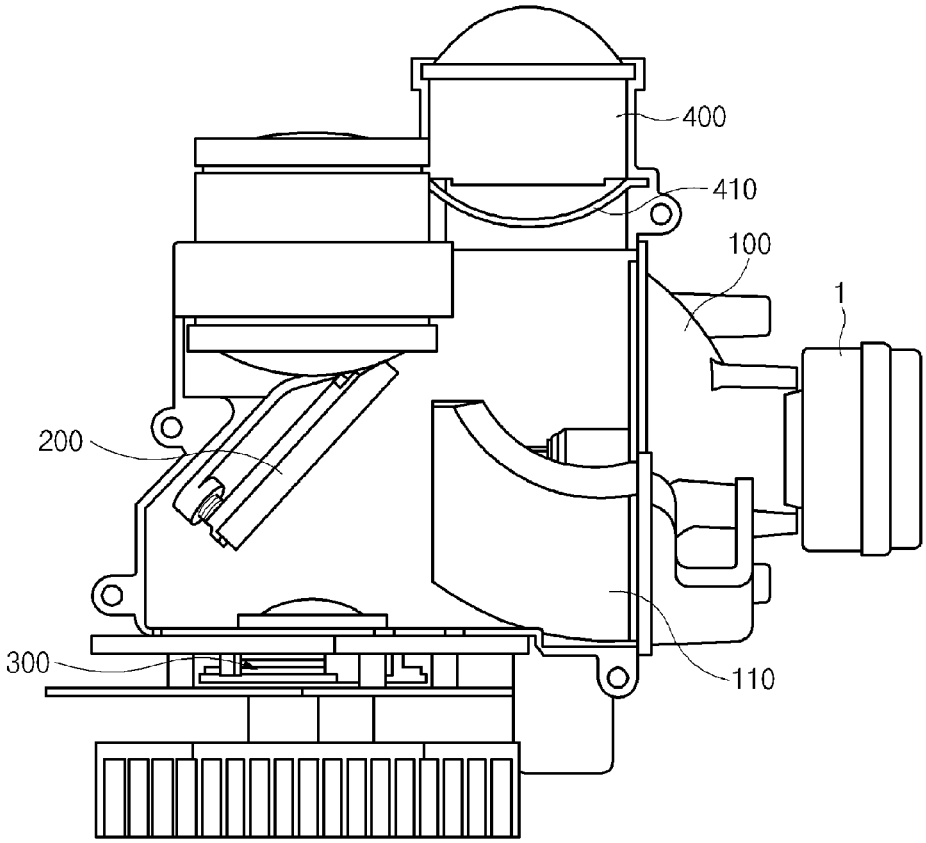
FIG. 5 is a view illustrating a shield and a reflector additionally mounted on an exemplary head lamp for a vehicle according to the present invention.
Figure 6:
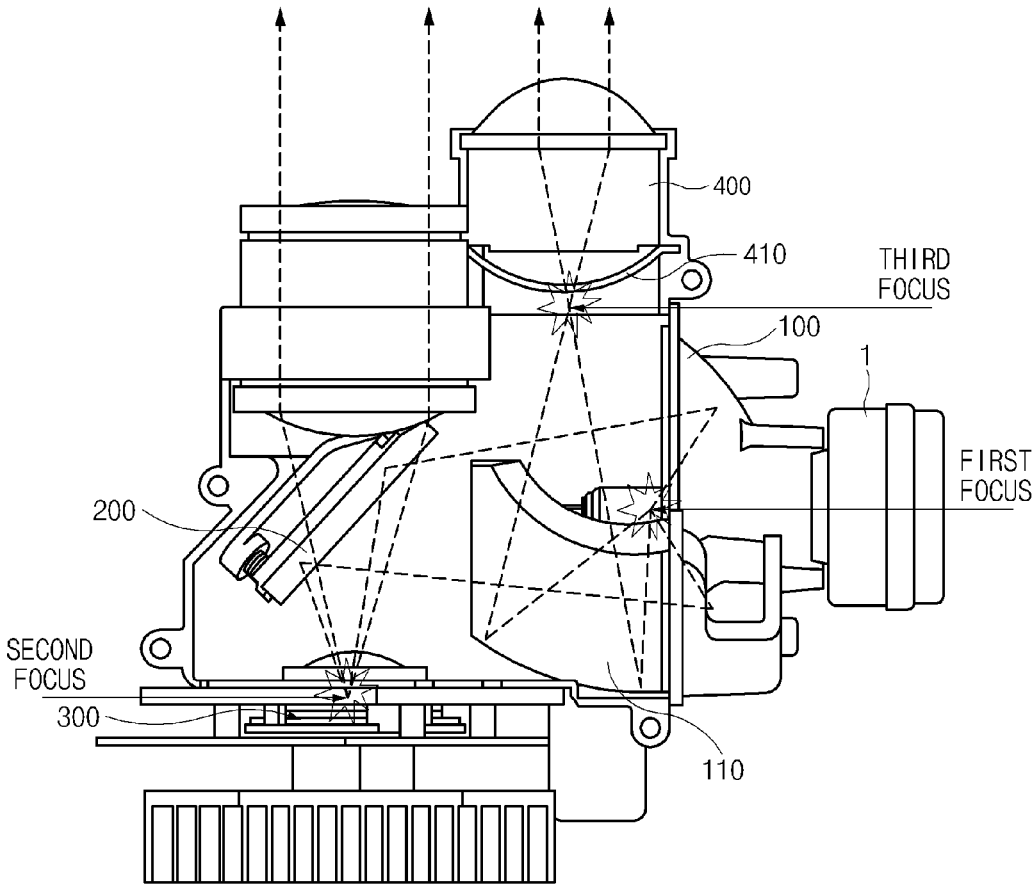
FIG. 6 is a view illustrating a light irradiation principle of an exemplary head lamp for a vehicle according to the present invention.

FIGS. 4 to 6 illustrate a head lamp for a vehicle according to the present invention. FIG. 4 is a view illustrating the head lamp for the vehicle according to the present invention. FIG. 5 is a view illustrating a shield and a reflector additionally mounted on the head lamp for the vehicle according to the present invention. FIG. 6 is a view illustrating a light irradiation principle of the head lamp for the vehicle according to the present invention.

The head lamp for the vehicle according to the present invention includes, as shown in FIGS. 4 to 6, a reflector 100 for reflecting light emitted from a light source 1, a reflection plate 200 for collecting the light reflected from the reflector in an upward direction, a micro-reflection module 300 provided over the reflector to tilt the light the light collected by the reflection plate, and an optical lens 400 for irradiating the light reflected from the micro-reflector onto a road surface.

Each component of the head lamp for the vehicle according to the present invention will be now described with reference to the accompanying drawings.

As shown in FIG. 4, the head lamp includes the reflector 100 for reflecting light emitted from the light source 1, the reflection plate 200 for collecting the light reflected from the reflector to the micro-reflection module 300, and the optical lens 400 for irradiating the light reflected from the micro-reflector onto the road surface.

The reflector 100 reflects the light emitted from the light source 1, and is disposed to enclose the light source 1.

In this instance, the light source 1 is a unit, which is provided in the head lamp for the vehicle, for emitting the light, and is turned ON/OFF by selection of a user.

The reflection plate 200 irradiates the light reflected from the reflector 100 in the upward direction to collect the light onto the micro-reflection module 300.

It is desirable that the reflection plate 200 is provided at one side of the reflector 100 in a slant state, as shown in FIG. 4, to irradiate the reflected light to the micro-reflection module 300.

The micro-reflection module 300 is provided over the reflection plate 200 to tilt the light collected by the reflection plate 200 at an angle and then reflect it in a forward direction of the vehicle.

In this instance, it is desirable that the micro-reflection module 300 includes a micro-reflector for tilting the light.

In addition, it is desirable that the micro-reflection module 300 is connected to an ECU (Electronic Control Unit) provided in the vehicle to receive vehicle information and navigation information and thus irradiate the information onto the road surface.

The vehicle information and the navigation information received from the ECU include a turn indicator, warning lamps, speed limit, a refuel gauge, a speed bump, and other information required for the driver. The micro-reflector receives the vehicle information to irradiate it onto the road surface, so that the driver can drive the vehicle conveniently and safely.

If the micro-reflector reflects the light incident at an angle to tilt the light in a positive direction, the light is emitted forwardly. If the light is tilted in a negative direction, the light is absorbed and thus is not emitted. As a result, the light is not emitted in the front of the vehicle when the beam pattern is implemented, and it is possible to select the radiation of the light when the vehicle information is irradiated onto the road surface.

Meanwhile, when the vehicle information is irradiated, the light is tilted in the negative direction, the region of the road surface on which the light is not irradiated is shown to the driver as a block color.

The optical lens 400 is provided at the front of the micro-reflection module 300 to irradiate the light reflected from the micro-reflector onto the road surface.

In this instance, in order to implement the light reflected from the micro-reflection module 300 clearly, it is desirable that the optical lens 400 is made of a spherical lens or an aspherical lens.

As shown in FIG. 5, it is desirable that an additional reflector 110 is provided between the reflector 100 and the reflection plate 200 to compensate the brightness of the light reflected from the micro-reflection module 300 and irradiated onto the road surface through the optical lens 400.

In addition, the lower end of the optical lens 400 is provided with a shield 410 to form a dark zone in a predetermined region, so that when the vehicle information and the navigation information are irradiated onto the road surface by the micro-reflection module 300, it does not impact on the dark zone shown to the driver.

The operation and effect of the present invention will now be described.

As shown in FIGS. 4 and 5, the head lamp the reflector 100 for reflecting the light emitted from the light source 1, the reflection plate 200 for collecting the light reflected from the reflector in the upward direction, the micro-reflection module 300 provided over the reflector 200 to tilt the light the light collected by the reflection plate, and the optical lens 400 for irradiating the light reflected from the micro-reflector onto the road surface.

The additional reflector 110 is interposed between the reflector 100 and the reflection plate 200 to compensate the brightness of the light. Further, the shield 410 is interposed between the optical lens 400 and the additional reflector 110 so as not to impact on the dark zone shown to the driver when the vehicle information and the navigation information are irradiated onto the road surface by the micro-reflection module 300.

The micro-reflector is provided in the micro-reflection module 300 to tilt the light. Also, the micro-reflection module 300 is connected to the ECU provided in the vehicle to receive vehicle information and navigation information and thus irradiate the information onto the road surface. As a result, the vehicle information and the navigation information is received from the ECU, and the turn indicator, the warning lamps, the speed limit, the refuel gauge, the speed bump, and other information required for the driver are irradiated onto the road surface, so that the driver can drive the vehicle conveniently and safely.

As shown in FIG. 6, the light emitted from the light source 1 which is the first focus is reflected from the reflector 100, and then is incident onto the reflection plate 200. Further, the micro-reflection module 300 which is a second focus is connected to the ECU, and the vehicle information supplied from the ECU is incident onto the micro-reflection module 300. Finally, the light tilted at a desired angle by the micro-reflection module 300 passes through the optical lens 400 made of a spherical lens or an aspherical lens, and then the converted beam pattern and the vehicle information are irradiated onto the road surface.

In addition, as shown in FIG. 6, the light emitted from the light source 1 which is the first focus is reflected from the additional reflector 110, and then passes through the shield 410 which is a third focus to form another beam pattern. The light generated by the process passes through the optical lens 400 to compensate the brightness of the light irradiated through the micro-reflection module 300 and not impact on the dark zone shown to the driver when the vehicle information and the navigation information are irradiated onto the road surface by the micro-reflection module 300.

The head lamp for the vehicle according to the present invention includes the reflector for reflecting the light emitted from the light source, the reflection plate for collecting the light reflected from the reflector in the upward direction, the micro-reflector provided over the reflector to tilt and reflect the light collected by the reflection plate at a desired angle, and the optical lens for irradiating the light reflected from the micro-reflector onto the road surface. Therefore, the head lamp can implement various beam patterns in accordance with road and surrounding circumferences, and irradiate vehicle information onto a road surface, thereby reducing the dazzle of other drivers of opposite vehicles and improving the field of vision of the driver to improve the safety and convenience.

For convenience in explanation and accurate definition in the appended claims, the terms upper or lower, front or rear, and etc. are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A head lamp for a vehicle comprising:

a reflector for reflecting light emitted from a light source;

a reflection plate for collecting the light reflected from the reflector in an upward direction;

a micro-reflector operably provided over the reflector to tilt and reflect the light collected by the reflection plate at a desired angle, wherein a focus of the light collected from the reflection plate is formed to the micro-reflector;

an optical lens for irradiating the light reflected from the micro-reflector onto a road surface;

an additional reflector for compensating brightness of the light reflected from the micro-reflector and passing through the optical lens; and a shield interposed between the optical lens and the additional reflector to form a dark zone in a desired region, thereby compensating the brightness of the light irradiated from the micro-reflector.

2. The head lamp according to claim 1, wherein the micro-reflector includes a micro-reflection module and selectively tilts the micro-reflection module.

3. The head lamp according to claim 1, wherein the micro-reflector is connected to an ECU provided in the vehicle to irradiate vehicle information onto the road surface through the optical lens.

* * * * *